US006231404B1

(12) United States Patent
Lichy

(10) Patent No.: US 6,231,404 B1
(45) Date of Patent: May 15, 2001

(54) CONNECTOR

(75) Inventor: Radim Lichy, Alingsås (SE)

(73) Assignee: ABB AB, Vasteras (SE)

( * ) Notice: Subject to any disclaimer, the term of this patent is extended or adjusted under 35 U.S.C. 154(b) by 0 days.

(21) Appl. No.: 09/381,148

(22) PCT Filed: Apr. 6, 1998

(86) PCT No.: PCT/SE98/00634

§ 371 Date: Jan. 13, 2000

§ 102(e) Date: Jan. 13, 2000

(87) PCT Pub. No.: WO98/45901

PCT Pub. Date: Oct. 15, 1998

(30) Foreign Application Priority Data

Apr. 7, 1997 (SE) ..... 9701298

(51) Int. Cl.[7] ..... H01R 4/36; H01R 4/38; H01R 4/30; H01R 13/73

(52) U.S. Cl. ..... 439/811; 439/801; 439/812; 439/921

(58) Field of Search ..... 439/811, 812, 439/810, 814, 370, 98, 801, 921; 174/40 CC

(56) References Cited

U.S. PATENT DOCUMENTS

| | | | | |
|---|---|---|---|---|
| 2,916,720 | | 12/1959 | Steans | 439/370 |
| 4,427,258 | | 1/1984 | Mueller | 439/814 |
| 4,812,012 | * | 3/1989 | Norden | 439/709 |
| 5,000,705 | * | 3/1991 | Kinka et al. | 439/797 |
| 6,011,218 | * | 1/2000 | Burek et al. | 174/40 CC |

FOREIGN PATENT DOCUMENTS

| | | |
|---|---|---|
| 3029904 | 3/1982 | (DE) . |
| 3210223 | 9/1983 | (DE) . |
| 3543596 | 6/1986 | (DE) . |
| 0655805 | 11/1994 | (EP) . |
| 0691721 | 6/1995 | (EP) . |
| 2503939 | 10/1982 | (FR) . |
| 2216737 | 10/1989 | (GB) . |

* cited by examiner

*Primary Examiner*—Lincoln Donovan
*Assistant Examiner*—Chandrika Prasad
(74) *Attorney, Agent, or Firm*—Connolly Bove Lodge & Hutz LLP

(57) ABSTRACT

A connector for connecting a power cable with solid insulation to medium-voltage equipment comprising a connection device arranged in an angular housing. The connector comprises a screwable pin contact which is connected to the cable core. The device comprises a guide sleeve, fixed in the angular housing, with an extension made in the shape of a jaw, into which sleeve the cable core is inserted, and a clamping block, into which the pin contact is threaded. The inner end of the pin contact makes contact with the jaw such that, when tightening the pin contact, the cable core is squeezed between the clamping block and the jaw. The angular housing comprises an outer semiconducting layer, the end of which, connecting onto the cable, is capable of being folded up. The connector is removable fixed to the medium-voltage equipment with a clamping device which is arranged in one piece of resilient wire.

12 Claims, 4 Drawing Sheets

CONNECTOR

TECHNICAL FIELD

The present invention relates to a connector for an insulated cable. The connector is intended for medium-voltage cables insulated with solid insulation and adapted for distribution networks up to 36 kV. The connection is adapted for current supply to switchgear or transformers for currents up to 250 A.

BACKGROUND ART

The task of a connector is to ensure an electrical connection between a cable and electric equipment. From patent document EP 0 655 805 A1, a connector is previously known, which shows a connector surrounded by an insulating body protected against hazardous contact. According to the known connector, the cable core is inserted into a sleeve-shaped contact shoe. In the side of the contact shoe, a hole is provided, into which a pin contact is threaded. The pin contact has a tool adaptor, which is provided with a notch. Upon reaching a torque, corresponding to a definite contact pressure on the cable core, the tool adaptor is arranged to be sheared off. The pin contact presses laterally against the exposed cable core and secures the cable core between the pin and the contact shoe. In so doing, the pin contact exerts a pressure only on some of the individual wires of the cable core.

The above-mentioned known connector solves the task of ensuring electrical connection in a complicated way. One problem is that the conductor wires are exposed to a local displacement such that they make contact with one another with such a force that they are deformed and hence damaged. By the different mechanical stresses on the conductor wires, different contact resistance and hence a non-uniform electrical stress on the cable core arise in unfavorable cases.

A further problem with the known connector is that the joint is not detachable, since, on the one hand, the tool adaptor is broken off and, on the other, the conductor wires are deformed during mounting. During repair or replacement of such a connector, the deformed end of the cable core must be cut off and the entire cable must be prepared anew, which requires a new effort. Nor does the known connector permit any reuse.

A disadvantage of the known connector is also that the pin contact, depending on the depth of screwing into the contact shoe, extends to differing degrees into a corresponding connection device in the equipment. Different thicknesses of the cable core therefore lead to differently sized contact surfaces being exposed in the pin contact.

An additional problem exists in the known connector, when measurement of the ground resistance of the cable screen is to be carried out. Usually, the outer conducting casing of the connector is connected to both the ground connection in the equipment and to the grounded cable screen. This ensures both mechanical protection and protection against hazardous contact, as well as a potential balance. To measure the ground resistance of the cable screen, this must be disengaged from all connection with ground or the outer conducting layer of the cable. For this purpose, the outer casing must be at least partly dismantled, which is time-and work-demanding.

To guarantee safe operation, the connector must be connected in an unseparable way with a bushing in the equipment. For this purpose, the connector must be held in contact position against the bushing. In bushings in the equipment there are eyes for attachment of a clamp making contact with the connector. Such a clamp exerts a pressure on the connector casing in a direction towards the equipment and hence fixes the connector in its contact position.

Known clamps usually consist of several parts and are relatively costly to manufacture. Usually, the clamps are applied with the aid of clamping screws which are tightened during mounting. It also occurs that the connector is held in position with the aid of springs which exert a clamping force over a yoke which makes contact with the connector.

SUMMARY OF THE INVENTION

The object of the invention is to provide a screened connector for current supply between, for example, a switchgear unit or a transformer and a medium-voltage cable, insulated with solid insulation, for distribution networks up to 36 kV. The connector is intended for indoor environments and to transmit currents up to 250 A. The cable core is subjected to less mechanical stress than known connectors. Measurement of the ground resistance of the cable screen in an installed connector is made possible. The connector permits a simple and electrically safe installation and is cost-effective. In addition, the electrical connection shall is capable of being dismantled and the parts are reusable. The disadvantage of the above-mentioned prior art design is avoided and the work and time expenditure during installation is reduced.

This is achieved according to the invention by a connector as described hereinafter. Advantageous embodiments are also described.

The connector according to the invention comprises a connection device arranged in an elastic insulating angular housing. The connection device comprises a clamping block placed in the angular housing, a pin contact being threaded in the side of the clamping block. A guide sleeve encloses the deinsulated end of the cable core and has an extension designed as a jaw. The jaw is inserted into the clamping block, the clamping block thus enclosing both the jaw and the cable core. The pin contact makes contact with the jaw and exerts, when being screwed in, a pressure against the jaw such that the cable core is clamped between that side of the clamping block, which is opposite to the pin contact, and the jaw. The contact pressure is thus evenly distributed over the conductor wires of the cable core end.

The thermal expansion of the cable core varies with different load states. The side parts of the clamping block are hence designed so thin that they become resilient when the cable core is expanded. In this way, a compressive force, which is partly independent of thermal variations, is created across the cable core. The necessary prestress pressure may thus be reduced to a minimum.

In a connector according to the invention, the pin contact always adopts the same contact position in the housing opening, independently of the depth of screwing. In this way, the plug-in depth and hence the contact surface for the pin contact will always be of the same magnitude, independently of the thickness of the connected cable core.

The angular housing is made of an elastic material and comprises several layers. The required potential equalization is achieved by constructing the outer layer of the housing of a semiconducting material and connecting it to the cable screen and to the ground of the equipment. Because of the elastic construction of the housing, it is possible to fold up that end of the housing which is connected to the cable and roll it backwards. This permits the connection between the cable screen and the outer casing of the connector to be separated. Measurement of the ground resistance of the cable screen and hence inspection of the cable sheath may thus be performed in a simple manner without separating the connector.

The connector is held in its contact position by a clamp which is made in one piece. The clamp is made of an elastic material, for example of a wire of spring steel and designed so as to receive a small spring constant with great capacity of movement. This is fulfilled, for example, if the clamp is brought to include at least one helical spring. In this way, the clamp may be easily clamped by hand. The spring force achieved is sufficient to securely fix the connector in its position in the equipment.

BRIEF DESCRIPTION OF THE DRAWINGS

The invention will be explained in greater detail, also with respect to further characteristics, by description of embodiments and with reference to the accompanying drawings in FIGS. 1–5, wherein.

DESCRIPTION OF THE PREFERRED EMBODIMENTS

Figure 1A:
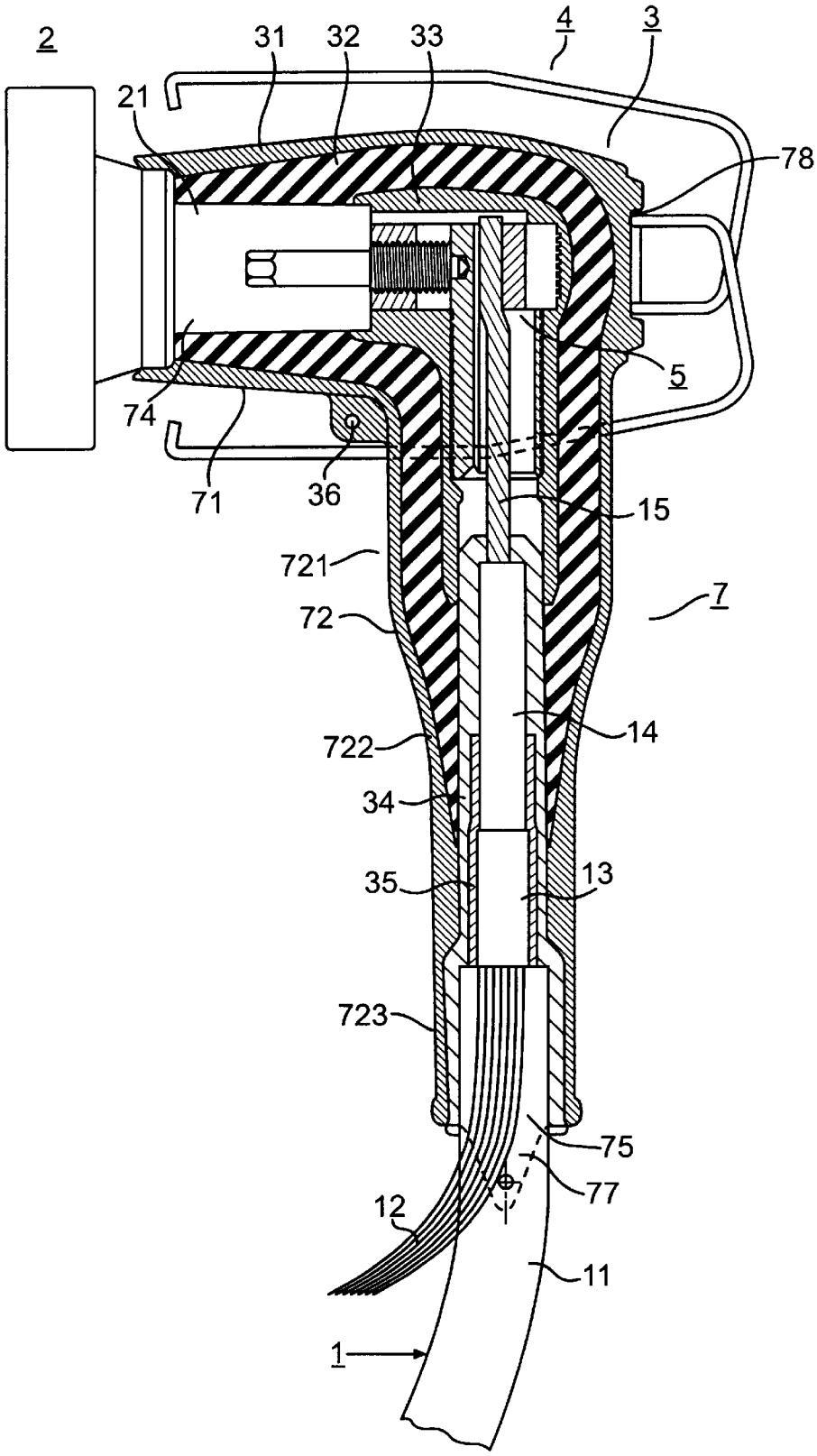
FIG. 1*a* shows a connector according to the invention, in longitudinal section.

FIG. 1*a* shows a connector 7 for a medium-voltage cable 1 comprising an angular housing 3, a connection device 5 arranged in the angular housing and a clamp 4 for fixing the connector against equipment 2. The angular housing 3 is made of an elastic material comprising a plurality of layers.

The angular housing 3 is built up of a first part 71 and a second part 72. Both parts are rotationally symmetrical around respective axes which cross each other. The first part 71 has an elongated rotationally symmetrical shape with tapering ends and a symmetry axis which is horizontal in the figure. The second part 72 has a symmetry axis which is vertical in the figure and which is essentially spool-shaped. The second part 72 of the angular housing comprises a first cylindrical section 721, a cone-shaped transition section 722 and a second cylindrical section 723. The transition section 722 connects the first section 721 to the second section 723 and has a diameter which is continuously changed. The second section 723, in the following designated rolling section, has a smaller diameter than the first section 721. The rolling section 723 comprises, in its lower end, two tongues 77 which are intended as a hand grip. The first part 71 of the angular housing and the second part 72 of the angular housing are perpendicular to each other in the embodiment shown.

The second part 72 of the angular housing is integrated with the first, thicker end of the first part 71 of the angular housing and has a continuous cylindrical hole 75 to the upper part 71. When mounting the connector 7, a prepared cable 1 is inserted into the cylindrical hole 75. A transition sleeve 34 is slid over the outer conducting layer 13 and the exposed insulation 14 of the cable 1, the sleeve extending downwards over part of the cable screen 12 and the cable sheath 11. A part of the transition sleeve 34, which abuts the outer conducting layer 13 and the insulation 14, is coated with a semiconducting layer 35. The layer 35 has a field-controlling function and ensures an electric field distribution, defined in advance, between the cable core 15 and the cable screen 12 inside the connector 7. For the different cable core cross sections, for which the connector 7 is intended, only one single variant or size of the transition sleeve 34 is needed.

The first part 71 of the angular housing has, in one end, a cylindrical or slightly conical opening 74 which fits into a bushing 21 arranged in the equipment 2. In that end of the first part of the angular housing, which is opposite to the equipment, a recess 78 is provided, with which a clamp 4, which will be described in more detail below, makes contact.

The angular housing 3 is built up of three different layers, vulcanized with each other. The outer layer 31 comprises semiconducting material and forms an outer safe-to-touch casing, which is in electrical connection with ground. Since the outer casing 31 only achieves a potential balance, and does not carry any electric current during operation, a semiconducting material may be used here. An eye 36 is formed in the angular housing 3 at a suitable location on the outer casing, as shown, for example, in FIG. 1*a*. During mounting, a wire of the cable screen 12 is connected to this eye 36 to ensure the potential balance between the cable screen 12 and the angular housing 3.

The middle layer 32 of the angular housing 3 is made to be insulating. The layer is sufficiently thick to insulate the cable core 15 from the outer casing 31 and ground. The inner layer 33 comprises a semiconducting material and is arranged in that part of the angular housing 3 which also accommodates the connection device 5. The semiconducting material achieves an equalization of the electric field to avoid field-strength concentrations on the edges of the connection device.

Figure 1B:
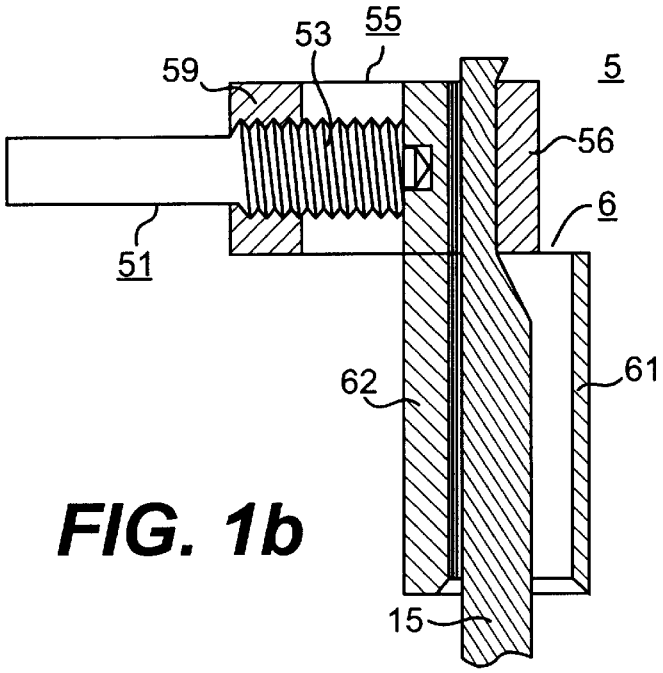
FIG. 1*b* shows a connection device, comprised in the connector, with a mounted cable core, in longitudinal section.

FIG. 1*b* shows the connection device 5, which comprises a clamping block 55 with a pin contact 51, threaded in the side thereof, and a guide sleeve 6 into which the cable core end is inserted. When mounting the connector 7, the connection device is premounted in the angular housing 3. During mounting, the cable core end 15 is inserted through the guide sleeve 6 such that it penetrates into an opening 58 in the clamping block 55.

Figure 2A:
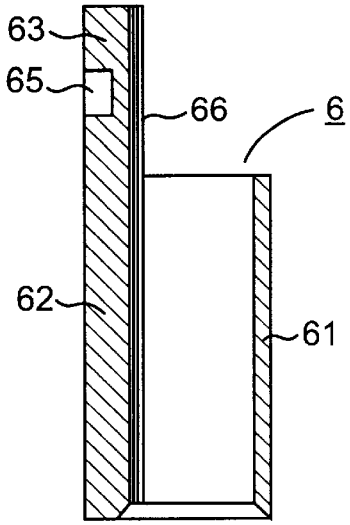
FIG. 2*a* shows a guide sleeve according to FIGS. 1*a* and 1*b* in longitudinal section.
Figure 2B:
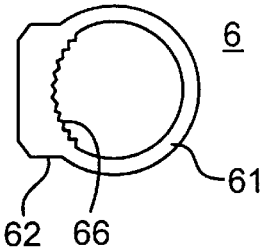
FIG. 2*b* shows a guide sleeve according to FIGS. 1*a* and 1*b* in plan view.

The guide sleeve 6, which is shown in FIGS. 2*a* and 2*b*, is tubular and may be bevelled on the inside of the lower end to facilitate insertion of the cable core 15. Along a sector of the cross section of the guide sleeve 6, the sleeve wall is thicker. In this way, a reinforced portion 62 is arranged extending along the sleeve. In its part facing the cable end, the guide sleeve 6 is cut off such that only the reinforced portion 62 extends into the clamping block 55, where it forms a jaw 63 between the cable core end 15 and the pin contact 51. To achieve better electrical contact with the cable core 15, longitudinal grooves 66 are arranged on the inner side of the reinforced section 62. A recess is arranged on the outer side of the jaw 63, the guide pin 54 being rotatably fixed in the recess.

Figure 3A:
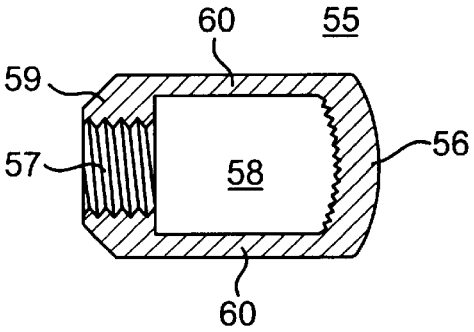
FIG. 3*a* shows a clamping block in plan view.
Figure 3B:
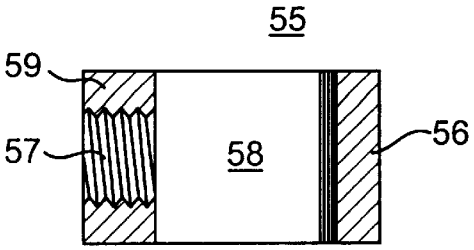
FIG. 3*b* shows a clamping block in side view.

The clamping block 55 shown in FIGS. 3*a* and 3*b* is designed as an essentially parallelepipedic hollow article with a continuous, essentially square cavity 58. The clamping block 55 with its cavity 58 is arranged to surround the cable core end and the jaw 63.

The clamping block 55 has a thick, front portion 59, in which a threaded hole 57, continuous to the cavity 58, is arranged. The threaded hole 57 is arranged preferably at right angles to the cavity 58. A pin contact 51 is screwed into the hole 57. The rear portion 56 of the clamping block 55 is thick and exhibits, at least on the inside, a concave arcuate shape. To achieve a better electrical contact with the cable core 15, the surface on the inner side of the rear portion 56 is grooved in a direction parallel to the cable core. On the inside of the clamping block, the rear portion may be bevelled at its lower edge to reduce the mechanical stress on the cable core 15. The side portions 60 of the clamping block 55 are made thin. In this way, the block is given elastic properties such that a change in volume of the cable core, caused by heat, may be absorbed without any play. The embodiment described permits the clamping block 55 to be manufactured in one size only, which fits a plurality of cable core cross sections.

Figure 3C:
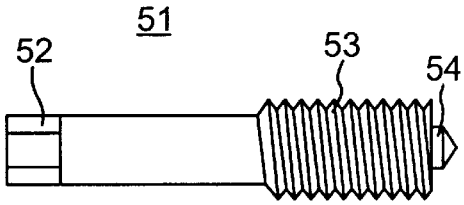
FIG. 3*c* shows a pin contact.

The pin contact 51 is shown in more detail in FIG. 3*c*. In one end, the pin contact 51 has a tool adaptor 52. This tool adaptor may be adapted to a hexagon spanner. At its other end, the pin contact 51 comprises a threaded portion 53 and outermost a guide pin 54 intended for fitting into the hole 65 of the jaw.

By tightening the pin contact 51, a pressure is exerted on the jaw 63 and hence the cable core 51 is clamped between the rear portion 56 of the clamp and the jaw 63. By the compacted connection, the contact resistance between the cable core 15, the clamping block 55, the jaw 63 and the pin contact 51 is maintained at a low level. The guide sleeve 6 is fixed in the angular housing 3. The guide pin 54 of the pin contact always makes contact with the jaw 63 of the guide sleeve 6. Therefore, the pin contact 51 will have a constant position in the angular housing 3. In that way, the pin contact always has the same position in the angular housing 3 of the connector, independently of the cross section of the cable core.

Figure 4A:
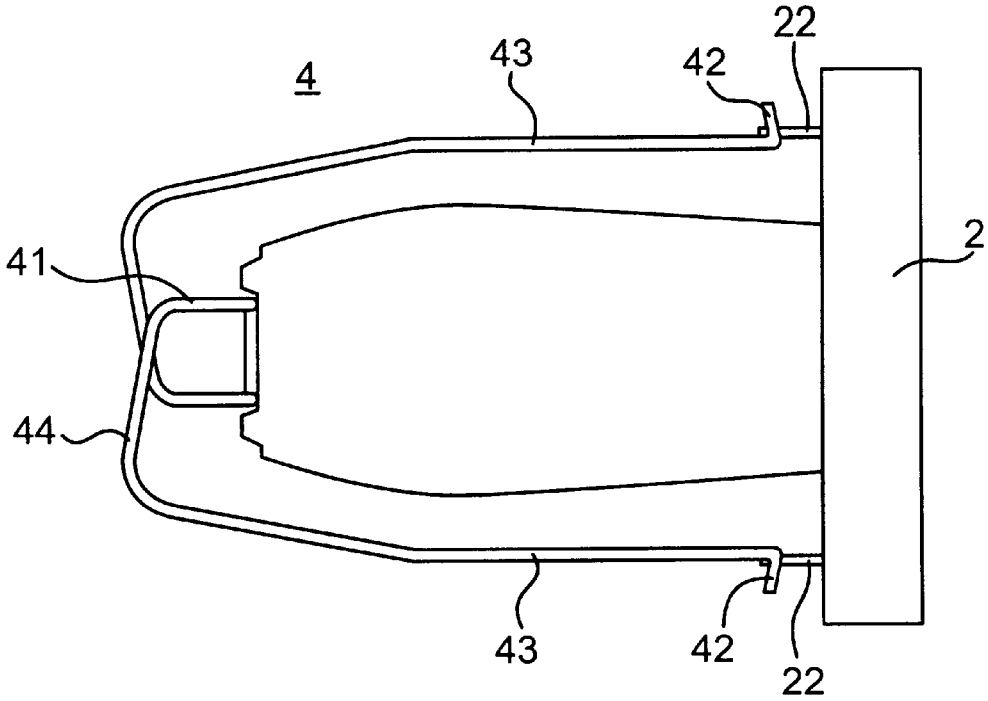
FIG. 4*a* shows a view of a clamp.
Figure 4B:
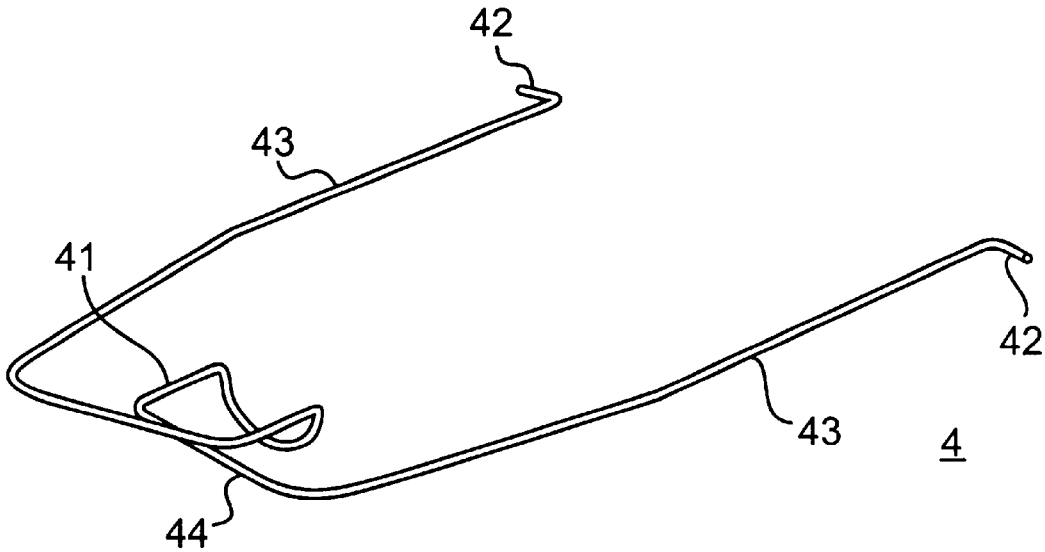
FIG. 4*b* shows a three-dimensional view of a clamp.

FIG. 4 shows a clamp 4. The clamp 4 is made of a wire of a resilient material, for example spring steel, and made in one piece. The clamp comprises essentially two legs 43 provided with hooks 42, the legs smoothly changing into a cross piece 44 arranged with a helical spring. During mounting, the hooks 42 are fitted into eyes 22 in the equipment 2. The legs 43 are designed essentially straight or slightly bent. FIG. 4 shows an embodiment, in which the legs 43 comprise two straight sections with a slight bend therebetween. The cross piece 44 deviates from the legs at angle between about 90° and 110°.

In the middle of the cross piece 44, the wire is arranged in a circular loop, in such a way that a helical spring with at least one turn 41 is achieved. The turn 41 may, as shown in the figure, be arranged in a plane parallel to the legs 43. To ensure that the clamp 4 is fixed to the connector 7, the spring comprises a portion which is bent at right angles to the plane of the spring and which fits into the recess 78 in the rear end of the first part 71 of the angular housing 3. The spring force attained through the material and the design of the clamp 4 ensures a good fixation of the connector 7 to the equipment 2.

Figure 5A:
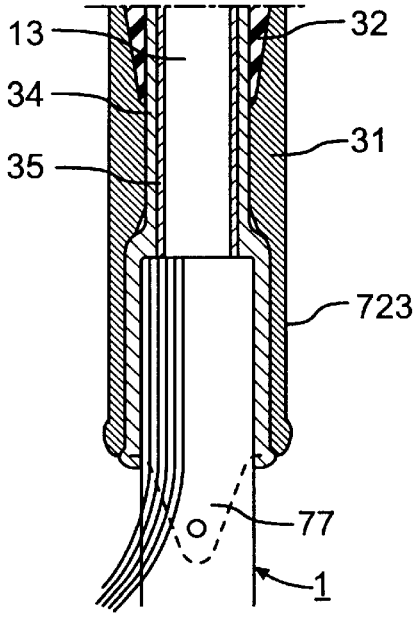
FIG. 5*a* shows a section of that part of the connector which is connected to the cable.
Figure 5B:
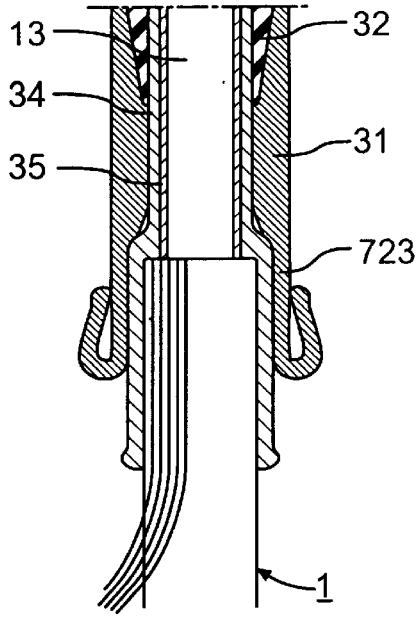
FIG. 5*b* shows the same section as in FIG. 5*a* but with the outer conducting part of the angular housing rolled up.
Figure 5C:
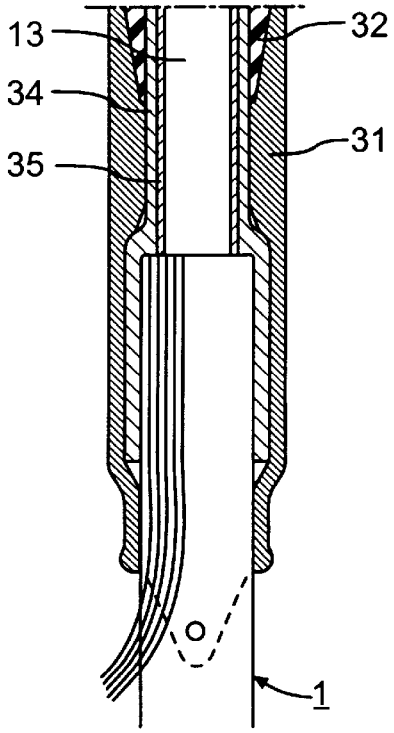
FIG. 5*c* shows a section of an advantageous embodiment of the lower, tapering part of the housing in mounted position.

The rolling section 723 with the two tongues 77 consists of semiconducting material. The roll section 723 is designed so as to be sufficiently elastic to be capable of being folded up from the cable and rolled backwards. FIG. 5*a* shows the roll section 723 in mounted position. Here, the roll section 723 makes contact in its entirety with the transition sleeve 34. FIG. 5*b* shows the roll section 723 in rolled-back position. The tongues 77 serve as hand grip to facilitate the folding up of the roll section 723. An advantageous embodiment of the invention is shown in FIG. 5*c*. Here the roll section 723 is made longer and extends downwards over the transition sleeve 34 and is connected with the cable sheath 11.

The invention is not limited to the embodiments described above. Other advantageous embodiments, in which, for example, the first and second parts 71, 72 of the angular housing 7 intersect each other at an arbitrary angle, are thus possible within the scope of the invention.

What is claimed is:

1. A connector for a power cable with solid insulation to medium-voltage equipment comprising a connection device arranged in an angular housing, in which device a screwable pin contact is connected to the cable core, wherein the device comprises a guide sleeve, fixed in the angular housing, with an extension designed as a jaw, into which sleeve the cable core is inserted, and a clamping block, into which the pin contact is threaded, wherein the inner end of the pin contact makes contact with the jaw such that, when tightening the pin contact, the cable core is clamped between the clamping block and the jaw.

2. A device according to claim 1, wherein the clamping block comprises an essentially parallelepipedic hollow article, a cavity of which is open at flat sides thereof and limited by two long sides, a rear portion and a front portion, in which the pin contact is threaded.

3. A connector according to claim 1, wherein the pin contact comprises a guide pin which is rotatably fixed into a hole provided in the jaw, whereby the pin contact when being clamped assumes the same position in the insulating body for all cable dimensions.

4. A connector according to claim 1, wherein those surfaces of the jaw and the clamping block which are facing the cable core are grooved.

5. A connector according to claim 2, wherein the long sides of the clamping block exhibit an elastic stretchability adapted to absorb changes in volume of the cable core in a non-play manner.

6. A connector according to claim 1, wherein the angular housing comprises an outer semiconducting layer, an end of which, connecting onto the cable, may be folded up, such that the electric connection between the cable screen and the outer casing of the connector is separable.

7. A connector according to claim 1, wherein the device is removably fixed to the medium-voltage equipment by means of a clamping device which is arranged in one piece of resilient wire, which is formed to elastically secure the connector to the equipment.

8. A connector according to claim 7, wherein the clamping device comprises at least one helical spring.

9. A method for connecting a power cable with solid insulation to medium-voltage equipment comprising the steps of providing a connection device arranged in an angular housing, in which device a screwable pin contact is brought into connection with the cable core, wherein the device comprises a guide sleeve which is fixed in the insulating body and which has an extension designed as a jaw, and providing a clamping block into which the pin contact is threaded and brought to make contact with the jaw, whereby the cable core is inserted into the guide sleeve, whereupon the pin contact is tightened such that the cable core is squeezed between the clamping block and the jaw.

10. A method according to claim 9, wherein the clamping block is arranged as an essentially parallelepipedic hollow article, a cavity of which is open towards flat sides thereof and in a front portion of which there is arranged a thread for the pin contact.

11. A method according to claim 9, wherein the pin contact is provided with a guide pin which is fixed rotatably in a recess which is provided in the jaw.

12. A method according to claim 9, wherein the connection device is arranged to be removably fixed to the medium-voltage equipment with a clamping device, which is arranged in one piece of resilient wire and which is formed such that the connector is elastically secured to the equipment.

* * * * *